United States Patent [19]

Glushko et al.

[11] 4,311,001

[45] Jan. 19, 1982

[54] METHOD FOR MANUFACTURING TWISTED WIRE PRODUCTS AND PRODUCT MADE BY THIS METHOD

[76] Inventors: Mikhail F. Glushko, prospekt Shevchenko 15/5, kv. 17; Viktor K. Skalatsky, ulitsa Zhukovskogo, 5, kv. 25; Vyacheslav G. Emelyanov, ulitsa Izvestkovaya, 81, kv. 32, all of Odessa; Sergei F. Korovainy, ulitsa Vokzalnaya, 70, kv. 29; Mikhail S. Koroschenko, ulitsa Vokzalnaya, 15, both of Khartsyzsk; Leonid D. Solomkin, ulitsa Generala Shvychina, 40, kv. 10, Odessa; Mikhail I. Stukalenko, ulitsa 50-letiya Oktyabrya, 70, selo Dobroalexandrovka, Ovidiopolsky raion, all of U.S.S.R.

[21] Appl. No.: 967,607

[22] Filed: Dec. 8, 1978

[51] Int. Cl.[3] ..... D07B 1/06

[52] U.S. Cl. ..... 57/215; 57/6; 57/9; 57/138; 57/212; 57/311

[58] Field of Search ..... 57/212, 213, 215, 216, 57/217, 3, 6, 9, 15, 210, 311, 138, 902

[56] References Cited

U.S. PATENT DOCUMENTS

| | | | |
|---|---|---|---|
| 2,492,352 | 12/1949 | Bourbon | 57/215 |
| 3,778,993 | 12/1973 | Glushko et al. | 57/212 X |
| 3,822,542 | 7/1974 | Nawd et al. | 57/215 |
| 3,872,659 | 3/1975 | Campbell et al. | 57/138 X |
| 3,922,841 | 12/1975 | Katsumata et al. | 57/215 |
| 4,158,946 | 6/1979 | Bourgois | 57/213 |

*Primary Examiner*—Donald Watkins

*Attorney, Agent, or Firm*—Lilling & Greenspan

[57] ABSTRACT

Wires are wound and simultaneously laid directly on the core of the product to form a wound layer between the adjacent wires of which there are peripheral spaces constituting from 15 to 70 percent of the wire diameter. The partly finished twisted wire product made in this manner is subjected to compression so as to cause its plastic deformation in order to obtain the desired shape and size. The wires of the wound layer of the finished product have a contact with the core substantially along the surface thereof as a result of compression applied to the product so as to cause its plastic deformation to produce the desired shape and size.

A twisted product made by applying this method has uniform mechanical properties over its whole cross section.

8 Claims, 17 Drawing Figures

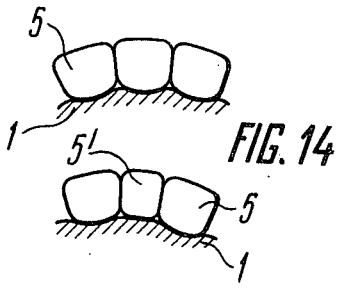
FIG. 14
FIG.15
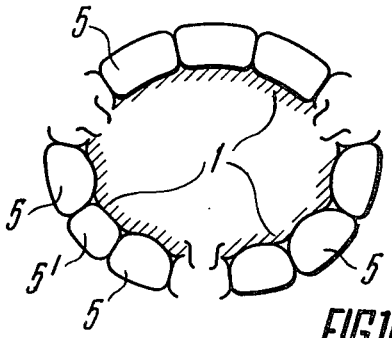
FIG.16
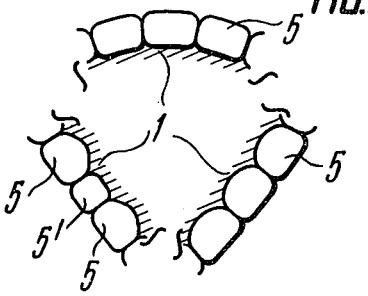
FIG.17

METHOD FOR MANUFACTURING TWISTED WIRE PRODUCTS AND PRODUCT MADE BY THIS METHOD

FIELD OF THE INVENTION

The present invention relates to twisted wire products and more particularly to methods of manufacturing twisted wire products and to constructions of products, such as ropes, made by these methods.

The invention is most suited for manufacturing rope strands and cores, wire armouring electric cables, overhead bimetallic power cables and the like.

BACKGROUND OF THE INVENTION

Known in the art are methods of manufacturing twisted wire products, such as ropes and cables, comprising winding of wires and laying the wound layers of wires over a core (here and in what follows, the term "core" is used to denote that portion of the product which is inside a wound layer) and applying compression to the partly finished product with the aid of reducing means so as to cause plastic deformation thereof with a view to imparting thereto the desired shape and size (cf. USSR Inventor's Certificate No. 55,676; Cl. D07B 1/06 and British Pat. Nos. 794,411, and 794,412; Cl. 83/4).

According to the known methods, all the wires to be used for manufacture of the product are tightly laid into their position inside a circumference having in cross section a contour of the product to be made, and are in contact with one another along the generating lines. When compression is applied to such products, the wires of the outer layer, acting along the periphery upon each other, form a tightly compressed circular layer, which prevents the compression force from being transferred from the periphery of the product to the core thereof. As a result of this disadvantage the core of the product does not undergo plastic deformation sufficient for filling air spaces within it with the metal of deformed wires, which lowers the strength of the finished twisted wire product.

To obtain a sufficient degree of deformation and hence better filling of air space within the core with the metal of deformed wires, it is necessary to increase the compression force, which, in turn, entails an increase of the equipment capacity, and makes the compression process more complicated.

Such measure, however, as limited by the safety factor of the deformed outer layer. If even the compactness and integrity of the outer layer are preserved, the deformation of the product over its cross section, irrespective of the increase of the compression force, proceeds not uniformly from the periphery towards the core, which affect the strength and durability of the product.

Known in the art is also the method of manufacturing twisted wire products, such as ropes and cables (cf. U.S. Pat. No. 3,778,993; Cl. 57-145) comprising winding and laying wires over the core so as to form a wound layer, applying compression to the partly finished product in order to cause its plastic deformation for the purpose of imparting to it the desired shape and size. The wires of the layer being wound are so laid that part of them protrude above the adjacent wires of the same layer.

When compression is applied, the protruding wires are forced to wedge between the adjacent wires, which diminishes the initial deformation force. However, because of the excess metal resulted from the deformation of the wires, the outer layer takes a shape of a tightly compressed circular layer, which in the end, as indicated above, results in the insufficient strength of a twisted wire product and other disadvantages.

On the other hand, when protruding wires are forced in between the adjacent wires, not all the wires are deformed uniformly: the more deformed are protruding wires, and the less deformed are wires adjacent to them.

Irregular deformation of the wires leads, in the course of the use of the product, to their irregular wear and to a rapid spoilage of the more deformed wires whereby lowering reliability and the durability of the finished product.

In comparison with the prior arts the above method when applied for manufacture of a product having the same size, necessitates the increase of the ratio between the size of wires of the wound layer and that of the core. This entails the increase in the number of standard sizes of the wires used for manufacture of some products, and also affects reliability thereof. The principal object of the present invention is to provide a method of manufacturing twisted wire products having a high reliability and durability.

Another object of the invention is to provide a method of manufacturing twisted wire products, wherein the process of winding and laying wires on the core ensures a uniform deformation of the product over its cross-section when it is subjected to compression.

Still another object of the present invention is to provide a method of manufacturing twisted wire products wherein after compression there is provided a practically uniform deformation of the wires of the outer layer.

A further object of the present invention is to provide a twisted wire product, such as a rope, with wires of the outer layer, being able to relatively shift without deforming the product shape.

A still further object of the present invention is to provide a twisted wire product such as a rope, having a minimum number of the wire sizes.

SUMMARY OF THE INVENTION

These and other objects are attained by that in a method for manufacturing twisted wire products, comprising winding and laying wires on a core to form at least one wound layer of wires; and applying compression to the produced semi-product so as to cause its plastic deformation for imparting thereto the desired shape and size, the wires of the layer being wound are laid according to the invention on the core so as to form peripheral spaces between them in order to ensure a uniform deformation of the product over the cross-section thereof as compression is applied thereto.

It is possible to wind and lay the adjacent wires of the layer being wound with peripheral spaces therebetween. Such spaces between the adjacent wires of the wound layer permit the range of the wire-core ratio to be increased and, consequently, the number of wire sizes to be considerably reduced.

It is also possible that wires of the layer being wound be wound and laid so as to form groups of wires each such group containing at least two wires, with peripheral spaces being provided between adjacent groups. Such method makes it possible to manufacture twisted wire products, such as ropes, having a higher degree of flexibility, which ensures improved reliability and durability of the product.

It is expedient that the spaces between the wires of the wound layer be in the order of 15 to 70 percent of the diameter of these wires. The peripheral spaces constituting less than 15 percent of the diameter of the wires are not advisable since in such a case the effect of the present method is not attainable, whereas the spaces constituting more than 70 percent of the wire diameter necessitate a considerable compression force which perhaps may cause the shape of the outer layer wires to change, bringing down reliability and durability of the twisted wire product.

The wires of the layer being wound may be laid so that part of them will protrude radially above the rest of wires, the protruding wires being in contact with one of the core wires, whereas the rest of wires having a contact with two core wires. The product is then radially compressed until every wire of the wound layer get in contact substantially with one wire of the core.

It is advantageous that in manufacturing twisted wire products comprising a plurality of wire layers, winding and laying of the wires over the previously wound layer be done successively, with the peripheral spaces being provided between the wires, applying compression to the produced twisted wire product after the wound layer has been laid with the peripheral spaces between the adjacent wires.

These and other objects of the invention are also attained in a twisted wire product made by the proposed method, comprising a core with at least one layer of wires wound thereon and having the desired shape and size obtained as a result of its having been radially compressed, the wires of the wound layer, according to the invention, have a contact with the core substantially throughout the surface thereof.

The adjacent wires of the wound layer in the spun wire product may be laid with respect to each other so as to form between them peripheral spaces constituting from about 1 to 10 percent of the product diameter. The peripheral spaces permit peripheral movement of the wires of the wound layer when the product is bent to a small radius, for example, on the drums, fleet wheels, and the like means having a small diameter.

It is advisable to lay the adjacent wires of the wound layer in the twisted wire product, such as a rope, so that they be in contact with each other along the helical lines, which permits the wires to turn about their axes without deforming the shape of the product.

It is advantageous to lay the adjacent wires of the wound layer in the twisted wire product, such as a rope, so that they have a contact with each other along the helical planes, which enables manufacture of a durable and compact product.

It is expedient that the adjacent wires of the wound layer in the twisted wire product, such as a rope, be laid in groups containing each at least two wires. It is also advisable that there be peripheral spaces between the groups of wires, the adjacent wires in each group being in contact with each other.

BRIEF DESCRIPTION OF THE DRAWINGS

The invention will now be explained detailed described in greater detail with reference to specific embodiments thereof taken in conjunction with the accompanying drawings, wherein:

FIG. 14 is a cross-sectional view of a product wherein the core is formed from a material having a lower strength than wires of the wound layer;

FIG. 15 is a cross-sectional view of a product made from wires of different size;

FIGS. 16,17 arc cross-sectional views of a product having an oval and trihedral shapes.

DESCRIPTION OF THE PREFERRED EMBODIMENT OF THE INVENTION

According to the requirements that a twisted wire product is to meet, one prepares a required number of wires having corresponding size, shape and mechanical properties.

Figure 1:
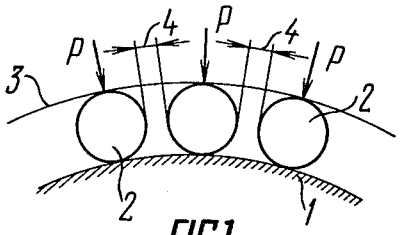
FIG. 1 is a cross-sectional view showing laying of wires of the wound layer over the core of the product before compression according to the invention.

Wires 2 (FIG. 1) are wound and laid directly on a core 1 of the wire product being manufactured to form a wound layer 3, winding and laying being done so as to form peripheral spaces 4 between the adjacent wires 2. A partly finished twisted wire product made in this manner is compressed with the aid of a reducing means (not shown) which may be a reducing die, rolls, etc.

When the product is compressed, the wires of the wound layer under action of the compression force F of the reducing means, deform and, due to their being free from contact with each other, transfer this force onto the core 1 providing for a uniform reduction of the product over its cross section.

Figure 2:
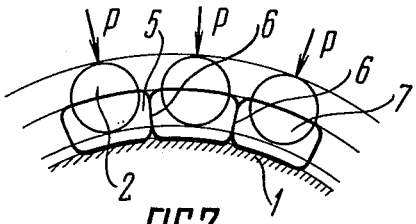
FIG. 2 is a view similar to the shown in FIG. 1, illustrating the position and shape of the wires of the wound layer after compression.

As the core 1 reduces counteracting to the compression force, the metal of wires redestributes along the periphery due to the presence of the peripheral spaces between the wires of the wound layer. An unimpeded transfer of the pressure force P onto the core can take place only when the metal of wires 5 (FIG. 2) of the wound layer redestributes peripherally until said wires get in contact 6 with each other along helical surfaces, i.e. until a tightly compressed circular layer 7 is formed.

The core 1 is a central member of the product. In general, the core may comprise one or plurality of wires, one-layer or multilayer twisted wire strands, and other similar twisted wire products of different sizes and shapes.

Since compressed circular layer 7 is formed after the reduction of the product over its cross section a high strength and durability of the finished twisted wire product are ensured.

At the same time, since there is no necessity to overcome a resistance of the compressed circular layer the compression force necessary for the reduction of the product is considerably reduced, which simplifies reducing means and the process of reduction.

Presence of the spaces between wires of the wound layers permits the range of the ratio between the wires of this layer and the core, to be increased whereby bringing down the number of standard sizes used in the product. In some products this ratio may be equal to 1, that is all the wires making up the product have the same diameter.

It is necessary, however, to take into consideration that the spaces between said wires, constituting less than 15 percent of the diameter thereof, are not advisable as the tight circular layer starts to form, in fact, at the very beginning of the reduction. On the other hand, when these spaces are larger than 70 percent of the wire diameter, there arises the necessity to increase the compression force in order to provide for the maximum diminishing of the initial spaces to form a finished product.

Given below are examples of application of the present method for manufacturing twisted wire products.

EXAMPLE 1

Figure 3:
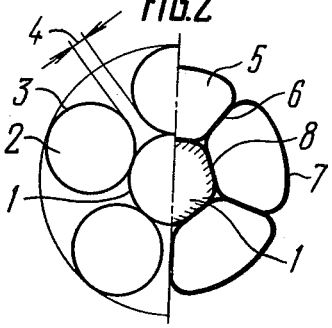
FIG. 3 is a cross-sectional view of a 1+5 construction before (thin line) and after (solid line) compression.

FIG. 3 represents a cross section of an alternative product of the 1+5 construction, comprising a core 1 (central wire) and five wires 2 of the wound layer. According to the proposed method the adjacent wires 2 were wound and laid so as to form peripheral space 4 constituting about 15 percent of the wire diameter (FIG. 3, left). The product made in this way was subjected to compression to initiate its plastic deformation (FIG. 3, right). As a result of compression the wires acquired substantially trapezoidal shape. The adjacent wires got in contact with each other and with the core 1 along helical surfaces 6 and 8, respectively.

Provision of spaces of about 15 percent on the similar products allows manufacture thereof from wires of the same diameter.

EXAMPLE 2

Figure 4:
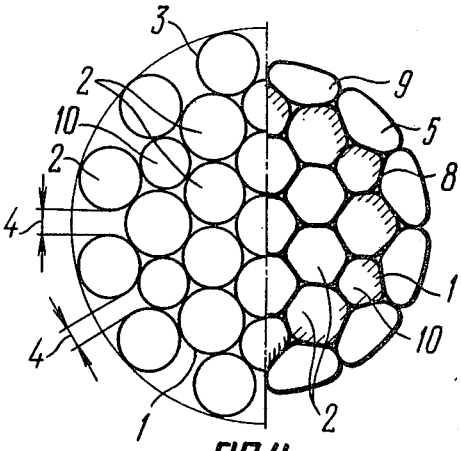
FIG. 4 is a cross-sectional view of a 1+6+6/6+12 construction before (thin line) and after (solid line) compression.

FIG. 4 represents a cross section of an alternative product of the 1+6+6/6+12/ construction (6/6 means that the wires are of different diameters), comprising a core 1 having a central wire and two layers made up of wires 2 and 10 with different diameters. Twelve wires 2 were wound and directly laid on the core 1 to form a wound layer 3. The wires were wound and laid so as to form between them spaces of about 35 percent of the diameter thereof. As the wires making up the core may be of different diameters, the wires of the layer being wound may be laid with different spaces 4 and 41 successively following each other and varying in size from each other by 50 percent.

The product obtained as a result of compression is uniformly reduced, with deformed wires 5 of the wound layer contacting each other along the helical surfaces 9 and the core along the helical surfaces 8.

Thus, owing to the presence of the peripheral spaces between adjacent wires, of about 35 percent of the diameter thereof, it was possible to manufacture the product from wires 2 and 10 of two different diameters. To make a product having the same characteristics by known methods, wires of four different diameters, as a minimum, are needed.

EXAMPLE 3

Figure 5:
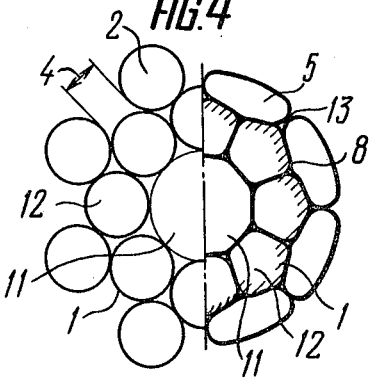
FIG. 5 is a cross-sectional view of a 1+8+8 construction before (thin line) and after (solid line) compression.

FIG. 5 represents a cross section of an alternative product of the 1+8+8 construction, comprising a core 1 consisting of a central wire 11 and a layer of eight wires 12. Eight wires 2 were wound and laid directly on the core 1 up to the contact therebetween to form a wound layer. The wires were wound and laid so as to form spaces of about 70 percent of the wire diameter between them.

The product obtained as a result of compression was uniformly reduced with deformed wires 5 having a contact with each other along the helical lines 13 and with the core along the helical surfaces 8.

The uniform deformation of the product over its whole cross section improves its compactness, strength and durability owing to the increased contacts along the helical surfaces 8 between the wires of the wound layer and the core. In addition peripheral spaces of about 70 percent of the wire diameter enable the manufacture of a product the layers of which are made up of wires 2 and 12 which are close in their size. At the same time manufacturing similar products by known methods requires either the wires with considerably different sizes or more wires with different diameters.

EXAMPLE 4

Figure 6:
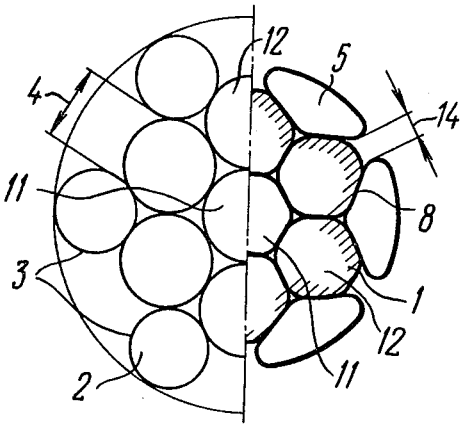
FIG. 6 is a cross-sectional view of a 1+6+6 construction before (thin line) and after (solid line) compression.

FIG. 6 represents an alternative product of a 1+6+6 construction. The product comprises a core 1 including a central wire 11 and six wires 12 of the first layer. Six wires 2 were wound and laid over the core 1 to form a layer with peripheral spaces of more than 70 percent of the wire diameter.

In the product obtained as a result of compression between deformed wires 5 of the wound layer there were formed peripheral spaces 14, the wires being in contact with a core along the helical surfaces 8.

It can be seen from the above example (FIG. 6) that with the increase of the peripheral spaces the shape of the wires of the wound layer greatly deforms as a result of compression, which, in some cases, may be not desirable, in particular, when the product has to be bent to a small radius.

EXAMPLE 5

Figure 7:
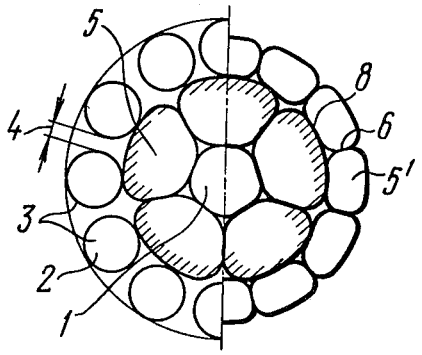
FIG. 7 is a cross-sectional view of a 1+5+12 construction before (thin line) and after (solid line) compression.

FIG. 7 represents an alternative multilayer product of a 1+5+12 construction. Said product was manufactured in the following way. Wires were wound and laid over a core 1 represented by a central wire to form the first layer in which the adjacent wires are located with peripheral spaces (as shown in FIG. 3). The product was then subjected to compression. Wires 2 of the next layer 3 were laid upon the previous layer of the deformed wires 5 to form peripheral spaces 4 and then subjected to compression to form the finished product, in which the deformed wires $5^1$ were in contact with each other along the helical surfaces 6 and with the core along the helical surfaces 8.

As can be seen from the above example, compression to each layer of the product was applied after laying of the wound layer in which there were peripheral spaces between adjacent wires.

This permits manufacture of products higher compactness and strength with decreased contact stresses between layers, which ensures their better durability.

EXAMPLE 6

Figure 8:
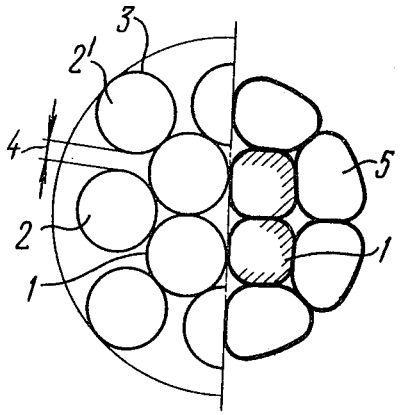
FIG. 8 is a cross-sectional view of a 4+8 construction before (thin line) and after (solid line) compression.

FIG. 8 represents an alternative multilayer product of a 4+8 construction, comprising a core 1 including four wires. The product was manufactured in the following way. Wires 2 and $2^1$ were wound and laid over the core 1 so that some of them, namely wires $2^1$, radially protruded above the rest of the wires namely wires 2. The protruding wires $2^1$ were in contact with one wire of the core whereas the wires 2 were each in contact with two wires of the core 1.

Products made in this way are not, substantially, round in cross section which permits their manufacture using wires the lesser number of standard sizes. As a rule, the number of the protruding wires $2^1$ and wires 2 may be not equal. Compression was applied to the product until each wire 5 of the wound layer as a result of a peripheral shift got in contact with only one wire of the core.

Owing to the above arrangement of the wires the finished product features, practically, uniform deformation of wires 5 and more uniform mechanical properties over its cross section. This enables manufacturing of such a product from wires of the same diameter.

EXAMPLE 7

Figure 9:
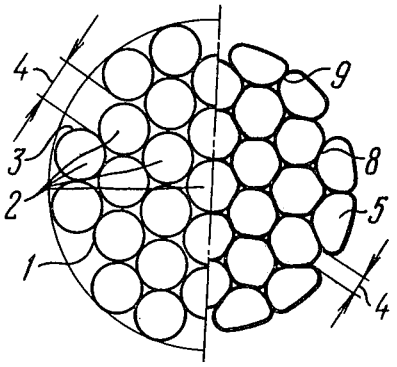
FIG. 9 is a cross-sectional view of a 1+6+12+12 construction before (thin line) and after (solid line) compression.

FIG. 9 represents a cross-sectional view of an alternative multilayer product of a 1+6+12+12 construction comprising a core 1 including a central wire and two layers formed from wires 2 having the same diameter. The product was made by winding and laying over the core 1 up to the contact therewith twelve wires 2 of the same diameter as the core wires, to form a wound layer 3, the wires being wound and layed so as to form groups containing two wires, with spaces 4 being provided between said groups, constituting 80 percent of their diameter.

As a result of compression there was made a finished product (solid lines) wherein a uniform deformation was obtained all the way to the contact of the deformed wires 5 of the wound layer with each other along the helical surfaces 9 and with the core along the helical lines 3, with peripheral spaces 4 of about 10 percent of the product diameter being formed between the adjacent wire groups of the finished product. Thus, owing to the initial peripheral spaces of about 80 percent between the adjacent wire groups, it was possible to make a product utilizing wires of the same diameter. To manufacture a product of such a quality by the known methods, four different wire sizes, as a minimum, are needed. Besides, the finished product having peripheral spaces of about 10 percent between the groups of wires, features improved flexibility ensuring a higher durability of the product used on the load-lifting mechanisms with a ratio of $D/d<15$, where D is a diameter of a fleet wheel or drum (not shown), and d is a diameter of the product, i.e. rope.

EXAMPLE 8

Figure 10:
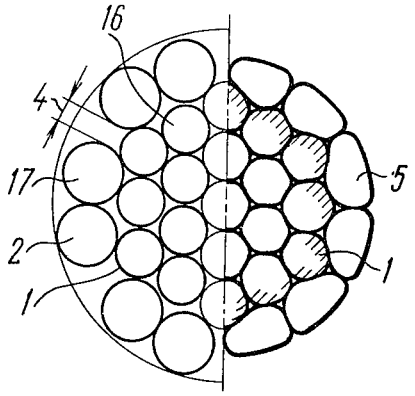
FIG. 10 is a cross-sectional view of a 1+6+12+12 multilayer construction before (thin line) and after (solid line) compression.

FIG. 10 represents a cross-sectional view of an alternative multilayer product a 1+6+12+12 construction, comprising a core 1 including a central wire and two layers of wires 16 of the same diameter. Wires 2,17 were wound and laid over the core 1 (thin lines) so as to form a layer made up of wire groups between which there were formed spaces 4 of about 90 percent of the wire diameter. Some of the wires, say wires 2, protruded radially above the rest, i.e. the wires 17, said wires 2 being in contact with one wire of the core 1, and the wires 17 having a contact with two wires of the core 1. The twisted wire product obtained was not round in cross-section and was similar to that in example 7.

The product was compressed so that the wire 5 of the wound layer had a contact, as a result of the peripheral shift, with two wires of the core 1.

With above arrangement of wires, the resulting product features a practically uniform deformation of the wires 5 and more uniform mechanical properties of the wires over the cross-section of the product, which permits manufacture of a durable and compact product utilizing wires of two diameters.

EXAMPLE 9

Figure 11:
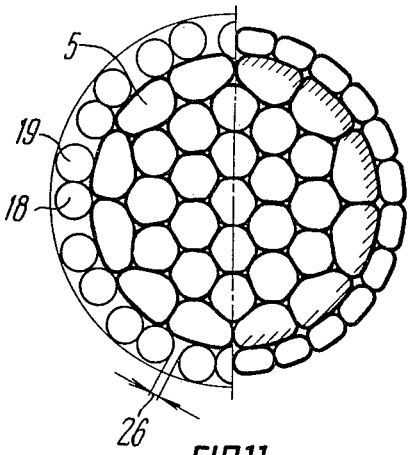
FIG. 11 is a cross-sectional view of a 1+6+12+12+24 multilayer construction before (thin line) and after (solid line) compression.

FIG. 11 represents another alternative multilayer product of a 1+6+12+12+24 construction, which was made in the following way. Wires were wound and laid over a core 1 of the twisted product of the 1+6+12 construction to form a wire layer wherein the wires were arranged in groups with peripheral spaces therebetween (as shown in FIG. 10). The obtained product was subjected to compression, whereafter on the previously laid layer of wires 5 there was wound and laid a next layer of wires 18 and 19 so that they were arranged in groups with peripheral spaces therebetween constituting about 15 percent of the wire diameter, some of the wires, namely wires 19, protruding radially above the rest of the wires, namely wires 18. As a result, the wires 19 had a contact with one wire of the core 1, whereas the wires 18 had a contact with two wires of the core 1. The twisted wire product obtained was not round in cross-section and was similar to that in example 7 and 8.

Compression to the product was applied so as to cause every wire of the wound layer to have a contact with one wire of the core. Thus, the finished product was substantially a plastically deformed one obtained as a result of its being compress layer by layer. As can be seen from the above example, compression to each wire layer of the product was applied after laying of the wound wire layer wherein there were peripheral spaces between the adjacent groups of wires, which permits manufacture of a durable and compact product featuring reduced contact stresses between layers, which in turn ensures its longer service life.

Thus, owing to the initial peripheral spaces 26 of about 40 percent between the adjacent groups of wires, it became possible to make a product with more uniform mechanical properties over its cross-section.

In addition, the finished product having peripheral spaces of about 2 percent between the wire groups features better flexibility ensuring increased durability of the product used on the load-lifting mechanisms with a ratio of $D/d<15$, where D is a diameter of the drum of a lifting mechanism, and d is a diameter of the product.

EXAMPLE 10

Figure 12:
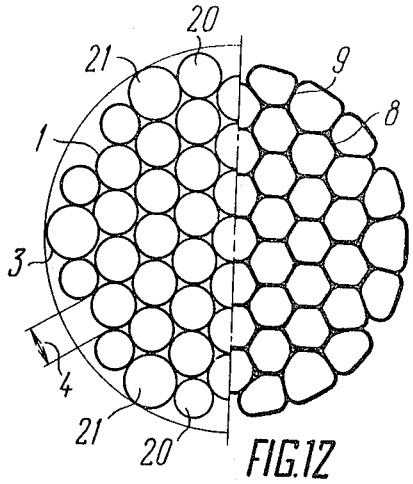
FIG. 12 is a cross-sectional view of a 1+6+12+18+12/6 construction before (thin line) and after (solid line) compression.

FIG. 12 represents still another alternative product of a 1+6+12+18+12/6 construction, comprising a core 1 having a central wire and three layers formed from wires of the same diameter, which was produced by winding and laying over and the core twelve wires 20 and six wires 21 of different diameters up to the contact with to form a wound layer 3. The wires 20 and 21 were wound and laid so as to form wire groups of three wires each, and spaces 4 of about 90 percent of the diameter of the wires 21 between said groups.

As a result of compression there was made the finished product wherein there was obtained a uniform deformation all the way to the contact of the deformed wires 20 and 21 of the wound layer with each other along the helical surfaces 9, and with the core 1 along the helical surfaces 8, with the peripheral spaces of about 5 of the product diameter being provided between the adjacent wire groups of the finished product.

Thus, owing to the initial peripheral spaces of about 90 percent between the adjacent wire groups, it became possible to make a product featuring more uniform mechanical properties over its cross-section.

In addition, the finished product having peripheral spaces of about 5 percent between wire groups features improved flexibility ensuring increased durability of the product used on the lifting mechanisms with a ratio of $D/d<20$, where D is a diameter of the drum of a lifting mechanism and d is a diameter of the product.

EXAMPLE 11

Figure 13:
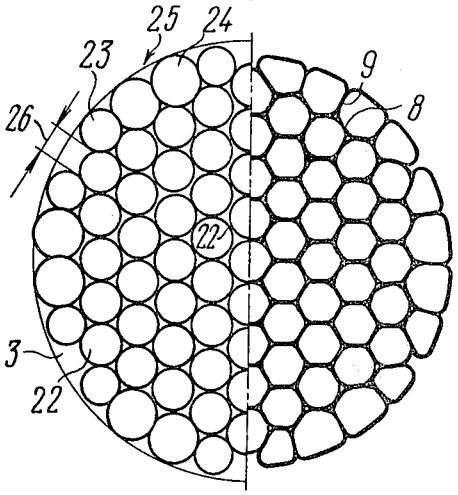
FIG. 13 is a cross-sectional view of a 1+6+12+18+24+12/12 construction before (thin line) and after (solid line) compression.

FIG. 13 represents a cross-sectional view of a further alternative product of a 1+6+12+18+24+12/12 construction, comprising a core 1 having a central wire and four wire layers formed from wires 22 of the same diameter. The product was made by winding and laying over the core 1 twelve wires 23 and twelve wires 24 up to the contact therewith, to form a wound layer 3. The wires were wound and laid so that they formed wire groups 25 each containing four wires, and between which there were provided peripheral spaces 26 of about 40 percent of the joint diameter of the wires 24 and 23.

As a result of compression there was made a product wherein a uniform deformation was obtained all the way to the contact of wires 23 and 24 of the wound layer with each other over the helical surfaces 9 and with the core 1 over the helical surfaces 8, with peripheral spaces of about 2 percent of the product diameter being provided between the adjacent groups of wires.

The proposed method can be applied for manufacturing products, such as ropes, wherein the wires of the wound layer have a surface contact with the core substantially the surface thereof. The following modifications of the above product are possible.

FIG. 4 illustrates a product, such as a rope, in which the contact 8 between the wires 5 of the wound layer and the core along a helical surface is larger than contact 9 between wires 5 along a helical surface.

FIG. 5 illustrates a product, such as a rope, in which the contact 8 between the wires 5 and the core along a helical surface is larger than the contact 13 between the wires 5 along a helical line.

FIG. 6 illustrates a product, such as a rope, in which the contact 8 between the wires 5 and the core along a helical surface is prevailing one as between the wires 5 there is a space 14.

Such construction of products provide relative shift of wires of the wound layer with respect to each other when above products are in use without deforming distorting the shape thereof, which increases their durability.

The above examples relate to the cases when the core and the wound layer are made from wires having about the same ultimate strength. It is advantageous in some cases to use a milder core, i.e. with a lesser ultimate strength than that of the wires of the wound layer. In such a case, under the action of the compression force the wires 5 of the wound layer are pressed in the core 1 without substantially changing their shape at the point of contact therewith (FIG. 14).

In the above examples of manufacturing products the wires of the wound layer are of the same size. There may be cases when the wires 5 and 5[1] of the wound layer differ in size. In this case the wires of the wound layer may acquire a shape like that shown in FIG. 15.

Other shapes of wires of the wound layer after compression are also possible, which depends on the material used for the core and wires of the wound layer, and on the degree of the product reduction.

It is possible to make, applying this method, products not only of a circular shape but of other shapes as well, and, in particular, of an oval one (FIG. 16) when wires 5 and 5[1] are laid on the core having an oval shape, trihedral shape (FIG. 17) when wires 5 and 5[1] are laid on the core of a trihedral shape and other shapes.

Initial shape of the cross-section of wires of the wound layer may also differ from a round one and may be oval or other one.

While particular embodiments of the invention have been shown and described, various modifications thereof will be apparent to those skilled in the art and therefore it is not intended that the invention be limited to the disclosed embodiments or to the details thereof and the departures may be made therefrom within the spirit and scope of the invention as defined in the claims.

What is claimed is:

1. A method for manufacturing twisted wire products having a core and a wound layer of wires located therearound and in contact therewith, comprising the steps of winding and laying wires directly on the core of the product to form at least one wound layer having peripheral spaces between its wires, said peripheral spaces constituting from 15 to 70 percent of the diameter of the wound wires, and applying compression to the partly finished product so as to cause plastic deformation thereof such that it acquires the desired cross-sectional shape and size.

2. A method as claimed in claim 1, wherein adjacent wires of the wound layer are wound and laid over the core of the product with peripheral spaces between said wires.

3. A method as claimed in claim 1, further including winding and laying a successive wire layer on the previously wound layer, applying compression to the partly finished product after the wound layer has been completely laid, with peripheral spaces provided between the adjacent wires, so as to form a product having a plurality of wire layers.

4. A method as claimed in claim 1, wherein the wires are wound and laid to form a wound layer having wire groups each containing at least two wires, with peripheral spaces being provided between adjacent wire groups.

5. A method as claimed in claim 1, wherein wires of the wound layer are wound and laid so that some of them protrude above the rest of wires, the protruding wires being in contact with one wire of the core, whereas the rest of wires being in contact with two wires of the core, compression being applied to the partly finished product until the wires of the wound layer are urged into contact substantially with one wire of the core.

6. A twisted wire product comprising a core and at least one wound layer of wires laid on said core, said wires of said wound layer contacting said core substantially along the surface thereof, between adjacent wires of the wound layer there are provided peripheral spaces constituting from 15 to 70 percent of the diameter of the wound wire, and adjacent wires of the wound layer are in contact with said core along helical lines.

7. A twisted wire product as claimed in claim 6, wherein adjacent wires of the wound layer are in contact with said core additionally along helical surfaces.

8. A twisted wire product as claimed in claim 6, wherein wires of the wound layer are arranged in groups between which there are provided peripheral spaces, the adjacent wires in each group being in contact with each other.

* * * * *